US009375622B2

(12) United States Patent
Bond

(10) Patent No.: US 9,375,622 B2
(45) Date of Patent: Jun. 28, 2016

(54) PERFECT SWING BASEBALL TRAINING APPARATUS

(71) Applicant: Frederic Bond, Cedar Grove, NJ (US)

(72) Inventor: Frederic Bond, Cedar Grove, NJ (US)

( * ) Notice: Subject to any disclaimer, the term of this patent is extended or adjusted under 35 U.S.C. 154(b) by 0 days.

(21) Appl. No.: 14/474,659

(22) Filed: Sep. 2, 2014

(65) Prior Publication Data

US 2015/0065272 A1 Mar. 5, 2015

Related U.S. Application Data

(60) Provisional application No. 61/873,146, filed on Sep. 3, 2013.

(51) Int. Cl.

*A63B 69/00* (2006.01)
*A63B 69/36* (2006.01)
*A63B 71/00* (2006.01)

(52) U.S. Cl.

CPC ..... *A63B 69/0002* (2013.01); *A63B 69/0075* (2013.01); *A63B 69/3641* (2013.01); *A63B 2069/0008* (2013.01); *A63B 2071/009* (2013.01); *A63B 2220/30* (2013.01); *A63B 2220/805* (2013.01); *A63B 2220/806* (2013.01); *A63B 2220/89* (2013.01); *A63B 2225/09* (2013.01); *A63B 2225/093* (2013.01)

(58) Field of Classification Search

CPC ..... A63B 69/0002; A63B 71/023; A63B 69/0057; A63B 69/0075; A63B 69/0079; A63B 69/0091

USPC ..... 473/417, 422, 451, 453, 428–430; D21/782

See application file for complete search history.

(56) References Cited

U.S. PATENT DOCUMENTS

| | | | | |
|---|---|---|---|---|
| 2,443,131 | A | 6/1948 | Fessler | |
| 2,985,452 | A | 5/1961 | Trippet | |
| 3,386,733 | A | 6/1968 | Small et al. | |
| 3,475,026 | A | 10/1969 | Cooper | |
| 3,904,199 | A | 9/1975 | Burchett | |
| 3,937,464 | A | 2/1976 | Zalewski | |
| 3,940,131 | A * | 2/1976 | St. Claire, Jr. | A63B 69/0002 473/417 |
| 3,948,517 | A * | 4/1976 | Feiler | A63B 69/0079 473/429 |
| D246,123 | S * | 10/1977 | Scoggins | 473/453 |
| 4,451,036 | A | 5/1984 | Sinclair et al. | |
| 4,516,771 | A | 5/1985 | Nau | |
| 5,226,645 | A | 7/1993 | Stewart | |
| 5,322,276 | A | 6/1994 | Hardison, Jr. | |
| 5,478,070 | A | 12/1995 | Morrison | |
| 5,595,384 | A | 1/1997 | Hardison, Jr. | |
| 5,711,726 | A | 1/1998 | Powers | |
| 6,435,990 | B1 | 8/2002 | Bradley | |
| 6,461,255 | B1 | 10/2002 | Smith | |
| 6,666,781 | B1 | 12/2003 | Illis | |

(Continued)

*Primary Examiner* — Mitra Aryanpour
(74) *Attorney, Agent, or Firm* — Gearhart Law, LLC

(57) ABSTRACT

A swing guide training apparatus may have a base with a vertical support where the vertical support can adjust the height of the apparatus. Opposite the base, there is a pair of swing guide arms forming a swing guide assembly. These swing guide arms are open on each end and are connected by a U-shaped member allowing a bat to be swung through the space provided by the swing guide assembly. The U-shaped member can be compressed or expanded to change the width of the swinging channel. Additionally, other features may be present such as a mount for holding a baseball and a device to measure the speed of the bat as it is swung through the swing channel. The swing guide assembly rotates to accommodate batters that are left and right handed.

15 Claims, 2 Drawing Sheets

(56) References Cited

U.S. PATENT DOCUMENTS

| | | | | |
|---|---|---|---|---|
| 6,878,077 | B2 | 4/2005 | Andrews | |
| 7,300,365 | B2 * | 11/2007 | Taylor | A63B 69/0057 473/422 |
| 7,819,763 | B2 | 10/2010 | Campell et al. | |
| 7,955,196 | B2 | 6/2011 | Constant | |
| 9,061,190 | B2 * | 6/2015 | Willardson | A63B 69/0002 473/453 |
| 9,067,113 | B2 * | 6/2015 | Kammer | A63B 69/0002 473/453 |
| 2003/0220177 | A1 * | 11/2003 | Orlando | A63B 21/04 482/148 |
| 2005/0130770 | A1 | 6/2005 | Battisto | |
| 2006/0089212 | A1 | 4/2006 | Marchel | |
| 2006/0148597 | A1 * | 7/2006 | Pope | A63B 69/0002 473/453 |
| 2007/0184921 | A1 | 8/2007 | Smith | |
| 2008/0248900 | A1 | 10/2008 | Hernandez | |
| 2010/0248853 | A1 | 9/2010 | Dellinger | |
| 2012/0264547 | A1 | 10/2012 | Windsor | |

* cited by examiner

PERFECT SWING BASEBALL TRAINING APPARATUS

CLAIM OF PRIORITY

This application claims the priority of U.S. Ser. No. 61/873,146 filed on Sep. 3, 2013, the contents of which are fully incorporated herein by reference.

FIELD OF THE INVENTION

The field of the invention relates to a sports training apparatus, namely devices designed to elicit a sport specific movement. In particular, the present invention is a guide assembly for teaching and/or correcting a baseball player's swing to the perfect swing.

BACKGROUND OF THE INVENTION

There is a great deal of debate on when the game of baseball started in the United States of America. However, the game most generally recognized as the first game played on American soil was in 1846. Thereafter, the game went through a number of rule revisions up until 1893. Since then, the rules of baseball have remained relatively unchanged. While the rules have remained the same, the approach to playing the game has seen a number of strategical advancements.

One such advancement is in the way batters swing their bat. For the longest time, batters have been taught to swing on an "A to C" plane. During this "A to C" swing, the player's hands move directly to the ball, and the barrel of the bat stays above the hands through the point of contact. This means that the players are taking the bat from behind their shoulder on a downward line and making contact with the lower portion of the ball and continuing their swing through the ball. Often times, especially in young ball players, this results in the batter's weight shifting forward in their stance and greatly reducing their power and momentum. The premise behind this swing style is that by hitting the lower portion of the ball and creating backspin, the ball will travel further off the bat. However, recent studies of the swings of some of the top baseball players in the world show a markedly different story.

Empirical evidence and an examination by the Entertainment and Sports Programming Network (ESPN) demonstrate that the bat should ideally follow a looping motion and be swung with a slight upswing through the ball in order to help maximize the flight path of the ball. In order to complete this swing, the rear shoulder must drop and the weight must be kept primarily over the back foot of the batter's stance. This means that the hands start out on a more curved path before making a hard turn to the right or left (depending on the handedness of the batter). This hard turn of the hands whips the head of the barrel out into the path of the ball with a slight upswing, propelling the ball substantially further than when one swings down the ball as described above. The inherent problem with the former swing style is not the ability to make contact with the ball, but rather the path of the ball. The "A to C" swing style creates a large number of groundballs. As players age, groundballs result in outs with an increased frequency. There is data to suggest that as many as 75% of groundballs result in outs in Major League Baseball (MLB). The looping swing style helps to propel the ball further and limit the amount of groundballs resulting in outs.

Thus, there is a need for an apparatus that assists to either teach or correct a batter's swing to enable them to maximize the flight path of the ball off the bat. This is done by providing a restricted swing area that mimics the preferred upswing motion. Additionally, there is a need for an apparatus that can be used and enjoyed by players that bat both left and right handed. There is another need for an apparatus that can progressively restrict a batter's swing to a predetermined swing path. There is also a need for an apparatus that can measure other factors related to the ball flight, such as bat speed, to help players achieve the maximum flight path. The current apparatus also requires the batter to prevent their weight from shifting forward during the swing in order to correctly and efficiently swing their bat through the apparatus. The current invention meets and exceeds all these limitations.

Review of Related Technology:

U.S. Pat. No. 5,087,039 pertains to a baseball bat swing training apparatus that includes a base which sits on the ground with a vertically extending post extending from the base. A baseball bat swing guide is attached to the post which has a pair of parallel swing guides connected at one end and open at the other end. The swing guide arms are positioned at a predetermined slope to the post of between 50 and 80 degrees. Each arm has an approximately 90 degree bend therein to form a bent U-shape. A ball holding cup can be attached to the lower arm while the ball holder can be attached to the upper arm and the vertically extending post is a telescoping post for adjusting the height thereof and may be a dual post. A second embodiment has a pair of posts and a pair of base members for supporting a pair of swing guide arms.

U.S. Pat. No. 4,577,863 pertains to a device that measures the height and inclination of a batter's swing plane by a batting practice device shaped like a home plate and including a laser source and photosensors for detecting laser light reflected by the bat when swung over the plate.

U.S. Pat. No. 3,904,199 pertains to a sports stroke training device having a post for mounting vertically on a vertical surface. The post is provided with a longitudinal groove for adjustably retaining a pivot shaft. An elongated bar is mounted intermediate its ends on the pivot shaft for pivotal movement thereon. The bar is provided at each of its ends with a flexible guide member which extends perpendicular from the bar in a direction from the post. A correct racket stroke is made when both guide members are hit during the stroke along the longitudinal centerline of the bar.

Various devices are known in the art. However, their structure and means of operation are substantially different from the present disclosure. In contrast to these devices, the current invention allows for an upward swinging/hitting angle, can be oriented for left or right handed batters, measures bat speed, and has an adjustable swing zone. Thus, the other inventions fail to solve all the problems taught by the present disclosure. At least one embodiment of this invention is presented in the drawings below and will be described in more detail herein.

SUMMARY OF THE INVENTION

A swing guide training apparatus is described and taught having a base member with a first vertical support of a specific diameter extending therefrom, wherein the first vertical support has a securing mechanism; a swing guide arm base attached to an upper end of a second vertical support, the second vertical support having a complimentary shape and having a smaller diameter than the first vertical support and is slidably coupled with the first vertical support to interact with the securing mechanism for maintaining the position of the second vertical support; a pitch assembly rotatably coupled to the swing guide arm base; a first swing guide arm coupled to the pitch assembly; and a second swing guide arm coupled to the first swing guide arm by an adjustable U-shaped member, wherein the first and the second swing guide arm are parallel to one another forming a swing guide assembly.

The swing guide training apparatus may have at least one ball holding mount extending from the swing guide arm base. The ball holding mount accepts a ball holding apparatus. This enables a ball to be positioned through the swing path for the batter to practice. In some instances, the swing training guide apparatus may have a measurement device, such as radar, to measure the speed of the bat as it is swung through the swing guide assembly. The measuring device is preferably attached to the adjustable U-shaped member. In order to prevent damage to the apparatus, it may be desirable to have protective coverings on each of the swing arms. These are preferably a strong, flexible tubing such a polyethylene. The base member of the apparatus has an angled support and a plurality of support legs extending therefrom. These legs may be collapsible and may have non-slip coverings to keep the apparatus stable and upright.

As the batter becomes more proficient in using the apparatus, the adjustable U-shaped member can be compressed. Alternatively, it can also be expanded as needed. This, in turn, changes the diameter, or vertical distance, between the first and second swing guide arms. The securing mechanism is preferably a thumb screw clamp. This clamp allows for quick and easy changing of height of the apparatus. Finally, the swing guide assembly rotates about the vertical axis. This enables batters who are left and right handed to use the apparatus.

In general, the present invention succeeds in conferring the following, and others not mentioned, benefits and objectives.

It is an object of the present invention to provide a baseball swing training device.

It is an object of the present invention to provide a baseball swing corrective device.

It is an object of the present invention to provide a baseball swing training device that forces a player to swing slightly upwards.

It is an object of the present invention to provide a baseball swing training device that is rotatable and can be used by left handed and right handed batters.

It is an object of the present invention to provide a baseball swing training device that can adjust in height to accommodate batters of varying stature.

It is an object of the present invention to provide a baseball swing training device that can adjust the pitch of the device thereby allowing batters to swing on differing trajectory planes.

It is an object of the present invention to provide a baseball swing training device that can widen or narrow the swing channel to accommodate batters of differing abilities.

It is an object of the present invention to provide a baseball swing training device that measures that speed of the batter's bat as it passes through the device.

It is an object of the present invention to provide a baseball swing training device that allows a batter to hit a ball.

It is an object of the present invention to provide a baseball swing training device that is lightweight and portable.

It is an object of the present invention to provide a baseball swing training device that is resistant to damage from bats.

It is an object of the present invention to provide a baseball swing training device that enables the batter to maximize the flight path of the baseball.

It is another object of the present invention to provide a baseball swing training device that forces a batter's weight remain positioned over their back foot.

DETAILED DESCRIPTION OF THE INVENTION

Figure 1:
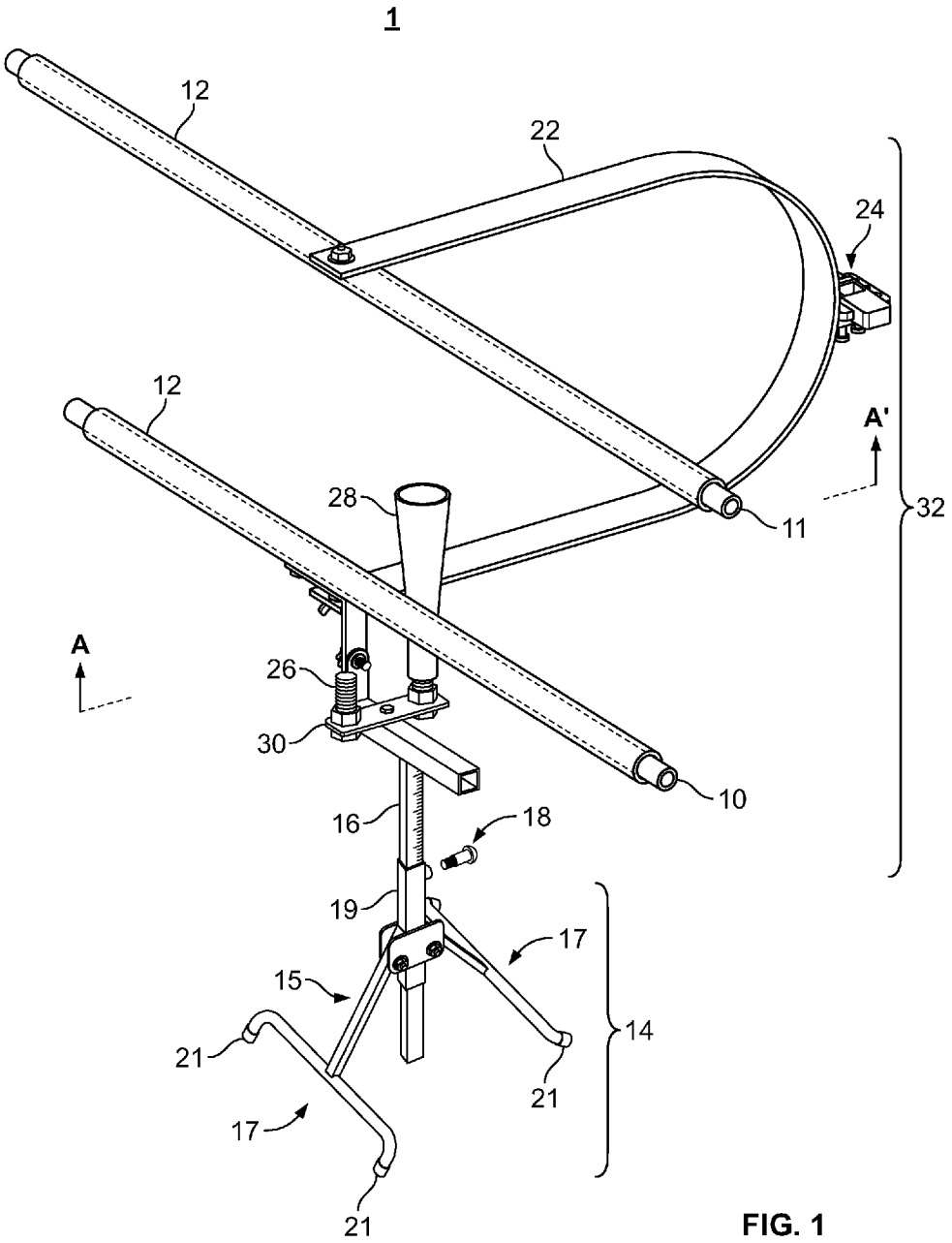
FIG. 1 is a perspective view of a preferred embodiment of the present invention.

The preferred embodiments of the present invention will now be described with reference to the drawings. Identical elements in the various figures are identified, as far as possible, with the same reference numerals. Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

Referring to FIG. 1, the preferred embodiment of the present invention is shown. The swing guide training apparatus 1 has a base member 14. The base member 14 has an angled support 15 and a plurality of support legs 17. The angled support 15 may be one continuous support piece, or it may be multiple pieces affixing to the sides of the first vertical support 19. Each of the plurality of support legs 17 may move independent of one another and may be collapsible. The collapsible legs will help aid in the storage of the apparatus 1. The support legs 17 may further have non-slip coverings 21. These non-slip coverings 21 may comprise a number of slip resistant materials including but not limited to rubber, neoprene, and silicone. Some embodiments may have an attachment or feature that permits the apparatus 1 to be staked into the ground for increased stability.

Extending from the base member 14 is a first vertical support 19. The first vertical support 19 is connected to the base member by a weld. Alternatively, the first vertical support 19 may be an extension of the base member 14 itself. Ideally, the first vertical support 19 is polygonal in shape having thickness with a hollow interior. The diameter of this support 19 can vary from about 2.5 cm (1 inch) to about 25 cm (10 inches). Preferably, the diameter is about 7.5 cm (3 inches). Alternatively the support 19 may be circular. The first vertical support 19 further has a securing mechanism 18 extending therethrough. The securing mechanism 18 is preferably a thumb screw clamp. This permits the securing mechanism 18 to be turned through a threaded opening in the first vertical support 19 thereby holding the second vertical support 16 in place.

The second vertical support 16 is smaller in diameter than the first vertical support 19, but has a similar, complimentary shape. The diameter of the second vertical support 16 is such that it fits and slides within the first vertical support 19. In some embodiments, it may be preferable that it is the second vertical support 16 has the larger diameter and the first vertical support 19 has the smaller diameter. This configuration does not change the inherent functionality of the apparatus 1.

Attached to the top end of the second vertical support 16 is a swing guide arm base 30. The swing guide arm base 30 is a rectangular piece of hardened plastic, rubber, or metal. On at least one end of the swing guide arm base 30 is a ball holding mount 26. Preferably, the ball holding mount 26 is a threaded bolt connected to the swing guide arm base 30. The ball holding mount 26 may also be smooth or coated with a tacky surface. Ideally, there is a ball holding mount 26 on each end of the swing guide arm base 30. This would allow a ball holding apparatus 28 to be placed on either end. Thus, the ball holding apparatus 28 could be moved to either side to accommodate a left or right handed batter. The ball holding mount 26 can be a number of shapes and sizes that will allow the swing guide arm assembly 32 to rotate freely about the vertical axis.

Extending from the swing guide arm base 30 is a pitch assembly 20 which is attached to the first swing guide arm 10. The pitch assembly 20 has a bracket with a plurality of holes (see FIG. 2) that enables the swing guide arm assembly 32 to move up and down. The swing guide arm assembly 32 can deviate up to about ±10° from its zero point and is held in place by another thumb screw. The general upward angle, above 90° relative to flat ground, creates the ideal swing pattern. It also forces a batter to keep their weight shifted to the rear of their stance. This promotes power and momentum throughout the duration of the swing, propelling the ball further. If the weight does come forward, the player will likely impact one of the protective coverings 12 or other part of the apparatus 1. The batter can then reswing focusing on the placement of their body weight. The pitch assembly 20 not only changes the angle that one swings, but can further be used to make accommodations for players of differing statures in addition to changing the height of the apparatus 1 as a whole.

The first swing guide arm 10 and second swing guide arm 11 are coupled by an adjustable U-shaped member 22. These elements form the foundation of the swing guide arm assembly 32. The swing guide arms 10, 11 can vary in length from about 0.5 m (20 inches) to about 1.0 m (39 inches) with an ideal length of about 0.8 m (31 inches). Each of the swing arms 10, 11 are parallel to one another. They ideally have a hollow walled construction and are circular in shape. Alternate embodiments may call for varying shapes or a solid walled construction depending on the material composition of the swing guide arms 10, 11. Preferably, each of the swing guide arms 10, 11 have a protective sheath 12 running the length of the swing guide arms 10, 11. This protective sheath 12 provides added protection against damage from bats to the swing guide arms 10, 11. Additionally, the inclusion of the protective sheath 12 may take some of the sting out a batter's hand if they hit either of the swing guide arms 10, 11. The protective sheath 12 should be flexible and may be any color. Acceptable materials may include polyurethanes, polyethylenes, nylons, polyvinylchlorides, polycarbonates, polypropylenes, and urethanes. This list is not exhaustive and may include other compounds exhibiting similar properties.

The swing guide arms 10, 11 are coupled by a U-shaped member 22. The U-shaped member 22 attaches to the under side of the first swing guide arm 10 and the upper side of the second swing guide arm 11. This places each of the attachment sites outside of the path of the swing thereby not interfering with the swing or possibly causing damage to the bat. The U-shaped member 22 is preferably a flat, flexible metal band. This enables a user to bring the swing guide arms 10, 11 closer together or pull them further apart. The swing guide arms 10, 11 always remain on parallel planes. The decrease or increase in the diameter between the swing guide arms 10, 11 changes the difficulty and precision needed to swing a bat through the apparatus 1. The U-shaped member 22 may also have an attachment for a bat speed measuring device 24. The bat speed measuring device may employ any number of tracking and speed calculation methods including but not limited to lasers, cameras, and radar.

Figure 2:
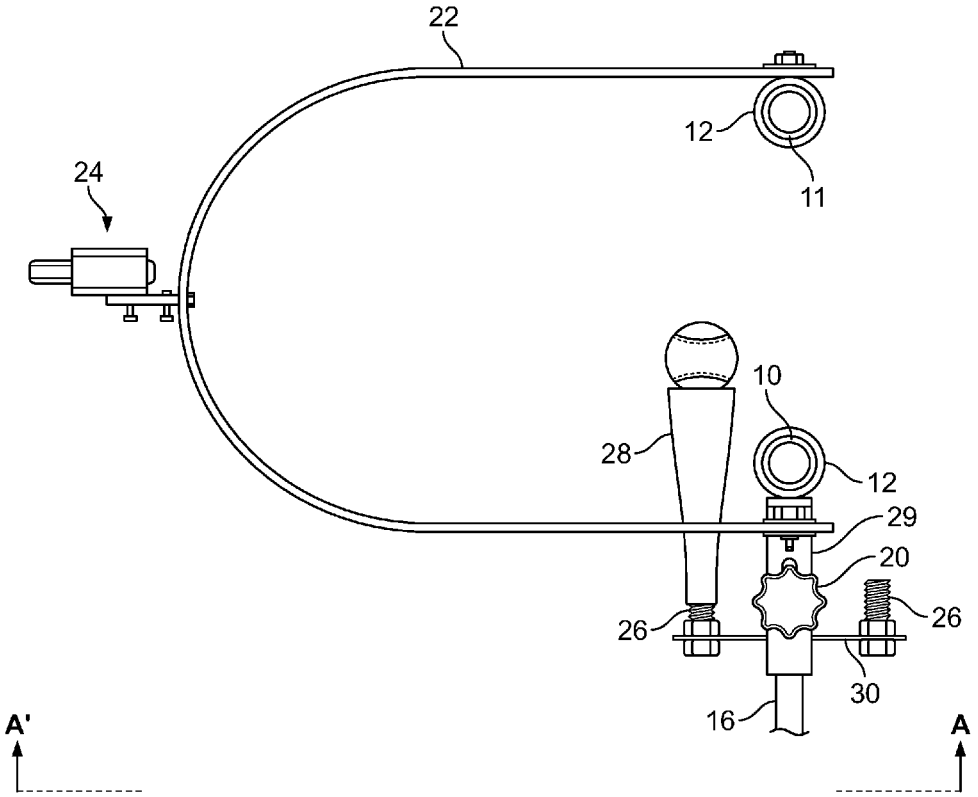
FIG. 2 is a side view along plane A-A' of a preferred embodiment of the present invention.

FIG. 2 shows the present invention along plane A-A' (see FIG. 1). Here, one can see clearly the components that form the heart of the invention. As the batter swings through the area defined by the first and second guide arm 10, 11 the bat must swing at a slightly upwards angle or one will contact the guide arms. The batter may desire to have a ball holding apparatus 28 present through their swing path. This can be used with or without a baseball to ensure the swing trajectory is correct to make solid contact. There are ball holding mounts 26 on either side of the midline of the apparatus 1. The swing guide arm assembly 32 is rotatable around the swing guide arm base 30. Thus, a left handed or right handed batter can each use the apparatus 1 and the ball holding apparatus 28 as well. The pitch adjustment 20 has a bracket with a plurality of holes 29 that enables the pitch of the swing guide arm assembly 32 to change. The swing guide assembly 32 can change pitch to influence the batter's swing trajectory or to provide a fine tune adjustment for players of different statures. Each of these features are present upon a swing guide arm base 30 attached to the second vertical support 16.

What is claimed is:

1. A swing guide training apparatus comprising:

a base member having a first vertical support extending therefrom, wherein the first vertical support has a securing mechanism;

a swing guide arm base oriented perpendicularly to a first swing guide arm and a second swing guide arm and having at least one threaded ball holding mount disposed thereon, the swing guide arm base further being attached to an upper end of a second vertical support, the second vertical support having a complimentary shape to the first vertical support and slidably coupled to the first vertical support;

wherein a ball holding apparatus is threadably engaged to the at least one threaded ball holding mount;

a pitch assembly rotatably coupled to the swing guide arm base;

the first swing guide arm coupled to the pitch assembly; and the second swing guide arm coupled to the first swing guide arm by an adjustable U-shaped member, wherein the first swing guide arm, the second swing guide arm, and the U-shaped member form a swing guide assembly, wherein the U-shaped member is rotatably coupled to the first and the second swing guide arms.

2. The swing guide training apparatus of claim 1 further comprising a bat speed measurement device attached to the adjustable U-shaped member.

3. The swing guide training apparatus of claim 1 further comprising protective coverings encasing each of the swing guide arms.

4. The swing guide training apparatus of claim 3 wherein the protective coverings are polyethylene tubing.

5. The swing guide training apparatus of claim 1 wherein the adjustable U-shaped member can increase or decrease the vertical distance between the first and the second swing guide arm.

6. The swing guide training apparatus of claim 1 wherein the U-shaped member is capable of being rotated about a vertical axis to accommodate left handed and right handed users.

7. The swing guide training apparatus of claim 1 wherein the securing mechanism permits manipulation of the height of the swing guide apparatus.

8. The swing guide training apparatus of claim 1 wherein the base member comprises an angled support with a plurality of support legs extending therefrom, wherein the plurality of support legs have non-slip coverings.

9. The swing guide training apparatus of claim 7 wherein the securing mechanism is a thumb screw clamp.

10. A swing guide training apparatus comprising:

a base member having a first vertical support of a first diameter extending therefrom, wherein the first vertical support has a securing mechanism;

a swing guide arm base attached to an upper end of a second vertical support and located below a first swing guide arm and having two threaded ball holding mounts extending vertically therefrom, the second vertical support having a complimentary shape to the first vertical support and having a second diameter and being slidably positioned within the first vertical support;

wherein the swing guide arm base is oriented perpendicularly with respect to the first swing guide arm and a second swing guide arm, wherein a ball holding apparatus extends above the first swing guide arm but below the second swing guide arm;

a pitch assembly rotatably coupled to the swing guide arm base;

the first swing guide arm being coupled to the pitch assembly; and the second swing guide arm being coupled to the first swing guide arm by a flexible and resilient U-shaped member, wherein the first swing guide arm, the second swing guide arm, and the U-shaped member form a swing guide assembly, the U-shaped member being rotatably coupled to the first and the second swing guide arms, wherein the U-shaped member is rotatable about a vertical axis, and wherein the first and the second swing guide arms are encased in a protective covering and are parallel to one another and configured to allow a bat to pass therethrough unimpeded.

11. The swing guide training apparatus of claim 10 further comprising a bat speed measuring device.

12. The swing guide training apparatus of claim 11 wherein the bat speed measuring device employs radar for calculating bat speed.

13. The swing guide training apparatus of claim 10 wherein the pitch assembly enables vertical deviations up to about ±10° in the swing guide arm assembly.

14. The swing guide training apparatus of claim 1 wherein the swing guide arm base has a first end and a second end with each of the first end and the second end being on an opposing side of the first and the second swing guide arms.

15. The swing guide training apparatus of claim 10 wherein the U-shaped member is coupled to an upper surface of the second swing guide arm and a lower surface of the second swing guide arm.

* * * * *